United States Patent [19]

Conway

[11] 3,967,455

[45] July 6, 1976

[54] CONTROLLED YIELDING ROCK BOLT

[75] Inventor: John P. Conway, Spokane, Wash.

[73] Assignee: The United States of America as represented by the Secretary of the Interior, Washington, D.C.

[22] Filed: Feb. 3, 1975

[21] Appl. No.: 546,641

[52] U.S. Cl. ..... 61/45 B; 85/62; 73/88 E

[51] Int. Cl.[2] ..... E21D 21/02

[58] Field of Search ..... 61/45 B; 116/114 R, 116/114 A, DIG. 34; 73/88 E, 88 F; 85/62

[56] References Cited

UNITED STATES PATENTS

| | | | |
|---|---|---|---|
| 2,738,754 | 3/1956 | Bierer | 116/DIG. 34 |
| 2,879,686 | 3/1959 | Lewis et al. | 85/62 |
| 3,161,174 | 12/1964 | Harrison | 73/88 E X |
| 3,283,566 | 11/1966 | Fietz | 73/88 E UX |
| 3,460,258 | 8/1969 | Geary et al. | 73/88 E UX |
| 3,646,553 | 2/1972 | Conkle | 85/62 X |
| 3,826,128 | 7/1974 | McVey et al. | 73/88 E |

FOREIGN PATENTS OR APPLICATIONS

| | | | |
|---|---|---|---|
| 1,484,533 | 5/1969 | Germany | 73/88 E |
| 861,685 | 2/1961 | United Kingdom | 61/45 B |

*Primary Examiner*—Dennis L. Taylor
*Attorney, Agent, or Firm*—Gersten Sadowsky; Donald R. Fraser

[57] ABSTRACT

A bolt assembly for supporting a mine roof or the like is disclosed having a yieldable coupling means at least at one end to allow controlled sagging of the rock to prevent exceeding the elastic limit of the bolt. An expandable anchor may be provided at the other end. The coupling means includes a collar having a die movable along deformable threads of the bolt when the rock load increases. This relative movement provides relief thereby assuring against the bolt becoming excessively tensioned. The die deforms the threads by coldflow extruding and flattening action against the crest of the threads. This action forms a frictional holding interface between the bolt and the collar and maintains substantially constant tension in the bolt. A nut on the collar transmits the supporting force to the rock face. A removable cap nut may be threaded onto the bolt to properly pre-position the parts and transmit torque to the anchor during installation.

8 Claims, 3 Drawing Figures

CONTROLLED YIELDING ROCK BOLT

The present invention relates to yielding fasteners, and more particularly, to a rock bolt assembly that allows controlled sag of a mine roof.

BACKGROUND OF THE INVENTION

As is well known in the mining art, in an underground mine, the roof must be supported at spaced intervals in order to assure the safety of the miners. For many years, this support was provided by shoring timbers positioned at spaced locations longitudinally along the mine tunnels. Shoring timbers have in recent years been almost totally replaced by modern rock bolt assemblies. These devices are inserted in bore holes along the rock face and serve to fasten the adjacent layers of rock together, thus preventing cave-ins. The safety of mines has improved considerably since the introduction and continued development of the modern rock bolt.

Heretofore, the rock bolt has been set in the bore hole and the rod or bolt simply tightened to a predetermined torque designed to support the strata of rock forming the rock face. The tension in the rod is usually gauged so that a safety factor is provided, i.e., the bolt assembly is tightened to a point below the elastic limit of the rod. If a serious fault develops in the rock, the tension increases and thereafter this bolt assembly imposes a safety hazard since failure may then occur at any time.

To alleviate the danger, there has been considerable development in the field of tension indicating devices, such as is shown in the U.S. Pat. No. to Cumming 3,133,468. These indicating devices help during the installation of the rock bolt assemblies, and are intended to alert mine personnel when the tension increases after installation. A spring washer or the like is flexed to varying degrees so the worker can determine when excessive tension is being approached.

These tension indicating devices are not designed for, and indeed are incapable of permitting, any more than minor rock face sagging. This is so, since the devices are merely spring devices with extremely limited travel. These prior art indicating devices also do not employ constant tension movement since mechanical springs are used. This latter feature means, that with a compression spring for example, the bolt is tensioned at a low setting equal only to some average spring force rating. When a fault occurs in the rock, the spring quickly bottoms out permitting the application of excessive force directly to the support rod. When the design force is exceeded in this way, failure inevitably occurs, just as in prior art rock bolt assemblies without indicating devices, unless the inspector is lucky enough to notice the change and has replaced the bolt before another rock shift occurs.

From this background, I have recognized a need for providing a rock bolt that allows reasonable rock sag in a mine and does so while maintaining a constant tension in the rod or bolt. The constant tension feature would be self-adjusting and thus prevent the elastic limit of the bolt from ever being reached. Extended travel is also necessary so that a rock fault within proven limits for a particular area may be accommodated. My theory is that if shifting of rock can occur while still maintaining the rock face in tact supported by the design tension, then cave-ins due to rock shifting can be virtually eliminated. This, in turn, will result in saving of lives, and it will also represent a considerable increase in efficiency since closing of mine shafts and clean up from wall failures will be minimized.

OBJECTIVES OF THE INVENTION

With the foregoing considerations in mind, it is a main object of the present invention to provide a rock bolt assembly that allows controlled yielding of the rock wall.

It is another object of the present invention to provide a rock bolt assembly that utilizes a simple design with the addition only of a special collar that allows controlled, constant tension movement of the wall.

It is still another object of the present invention to provide a yielding rock bolt assembly wherein the coupling means that provides the yield is characterized by deformation of threads by die on a sliding collar.

BRIEF DESCRIPTION OF THE INVENTION

A yielding rock bolt assembly includes a rod extending between the two areas to be fastened together, anchor means at one end, i.e., at the inner end of the bore, a collar movable along the rod and deformable holding means on the rod interacting with the collar. The deformable holding means and the collar couple the rock face support plate at the outer end of the bore and the expandable anchor at the inner end, thus holding the adjacent strata of rock together. As will be clear to those skilled in the art, the yieldable coupling concept of the present invention can be utilized in other areas where a controlled, constant tension movement between two areas is desirable. A coupling for parts of high pressure vessels to allow controlled expansion or any other application for a "mechanical fuse" is within the purview of the broader aspects of my invention.

The deformable holding means on the rod is preferably rolled threads having alternate crests and valleys. The collar includes a female die member adapted to mate with the threaded portion of the rod with an interference fit. The rod is tensioned during installation to a point where the upper few threads are extruded and flattened. The crest of the first few threads are actually moved by cold flow into the valleys between. This extruding action provides a frictional holding interface allowing controlled movement of the collar down the threaded section. That is, when this threshold tension used to initially set the coupling is exceeded, additional movement is allowed due to a developing fault thereby preventing the application of excessive force as would have occurred with the use of prior art rock bolt assemblies. Thus, the wall face is allowed to move inward from its original position to a new position where the same holding force and tension in the bolt is re-established.

As an incidental feature, when a fault has developed, the inspector in the mine can easily read the position of the coupling to see the extent of movement and can then take extra precautions to re-establish the shoring of the rock wall if necessary. If only a relatively small area has been traversed by the sagging of the rock, then the bolt assembly can by choice be left in position since upon the occurrence of another fault, the collar merely moves down an additional distance over the extended thread portion.

The die of the collar has a tapered leading bore portion and a straight bore portion, both of which are hardened to prevent wear. The leading portion allows the threads to be gradually crushed during the initial deformation adding smoothness and assuring controlled cold flow of the material, as desired. With the interference fit between the threads and the die, and more specifically a force fit between the straight portion and the collapsed threads, the necessary frictional interface is provided assuring a constant tension on the rod. The threads in the tapered portion act as a wedge providing the frictional holding force.

Since the holding action is a straight extruding action, the forces acting on the rod of the bolt assembly are pure tension. The spiral formation of the threads does not add any perceptable torque load to the bolt or rod. Thus, the strain on the bolt and the chances of failure by fatigue are further minimized.

To initially set the expandable anchor at the inner end of the bore, a cap nut may be placed on the bottom of the threaded rod. The cap nut holds the collar up clear of the supporting plate during this operation. A socket engaging the cap nut and driven by a suitable torque limiting power tool, positions the anchor and turns the rod until the anchor is set. Reversing the tool removes the cap nut and the plate supporting nut is then placed on the collar and properly torqued to establish the desired rock face support.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PREFERRED EMBODIMENT

Figure 1:
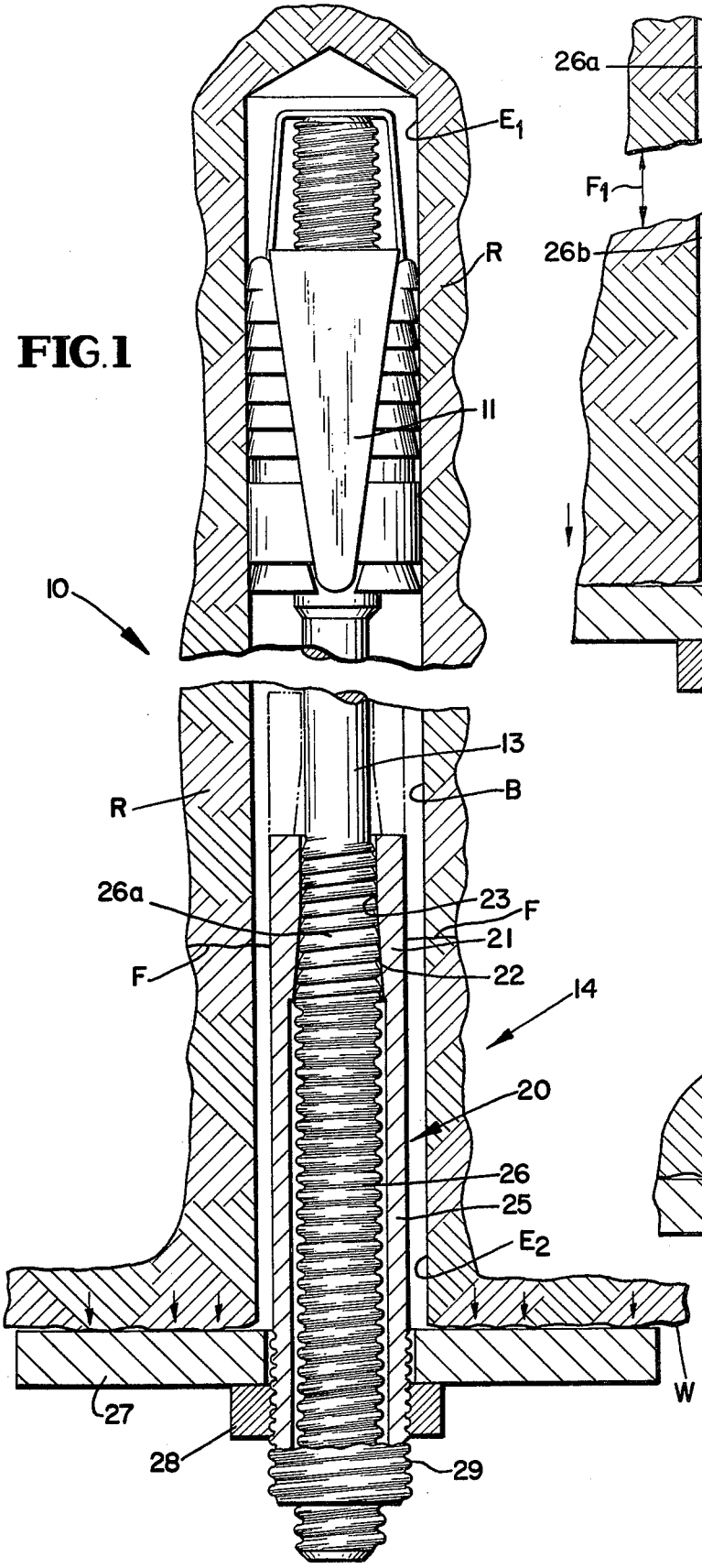
FIG. 1 is a detailed view partially in cross-section showing the fastener assembly mounted within a bore in a rock environment.

With reference to the structure shown in FIG. 1 representing the preferred embodiment of the invention, a more detailed description and analysis of the principles of the invention can be undertaken. A rock bolt assembly 10 is mounted in a rock formation R within a drilled bore B. At the upper part of FIG. 1 is illustrated the inner end $E_1$ of the bore B formed in a first area or strata of rock to be coupled to the lower end $E_2$ adjacent wall face W.

A standard expandable anchor 11 is locked in the expanded mode grasping the walls of the bore end $E_1$. In the center of the assembly is rod or shank portion of the bolt 13 (part broken away in drawing to conserve space). At the lower or outer end of the assembly 10 is a yieldable coupling device 14 constructed in accordance with the principles of the present invention. It will be clear that the rock bolt shown and described is a species of a generic fastener assembly that can be utilized in many environments where controlled, constant tension relative movement between two areas is desired, as will be more fully appreciated in the description below.

In the FIG. 1 showing, it will be understood that the anchor 11 has already been set. This is accomplished by torquing the bolt of the assembly prior to fully assembling the coupling means, as will be described later.

The yieldable coupling device 14 includes a collar, generally designated by the reference numeral 20. The collar 20 includes an upper tubular die section 21 with a tapered leading entrance portion 22 and a straight die portion 23. This entire die section has a sliding fit on the rod 13 so that the entire collar may move up and down as desired, prior to the collar 20 being set into holding position as shown.

The lower part of the collar 20 comprises an extension section 25 that surrounds threads or threaded section 26 formed on the rod 13. These threads form the deformable holding means that cooperates with the die 21 at the top of the collar. At the lower or outer end of the collar 20, a plate 27 is received with a threaded nut 28 engaging external threads 29 on the collar 20 to provide the support to the face W.

In order to illustrate the principles of the present invention, a fault line F has been shown across the rock structure R. This can be an interface between two different rock strata or a crack in any particular one of these layers. This is a typical situation and is intended merely to illustrate the principles involved in a yielding bolt when the fault develops, as will be seen more in detail later in the discussion of FIG. 2.

The basic installation and operation of the coupling device 14 is very simple. After the anchor 11 has been set and the collar 20 is positioned with the die 21 resting by gravity against the first thread (see dotted line outline of die 21 in FIG. 1), the plate 27 is simply slipped over the threaded end 29 of the collar 20. The nut 28 is next put on to draw the die 21 snugly against the first thread of the threads or threaded section 26. With a torque wrench, or with other suitable wrench and tension measuring means, the nut 28 is tightened, drawing the die 21 downwardly over the first group of threads **26*a* (note full line position of FIG. 1). The threads as they are forced into the entrance portion 22 of the die 21 are progressively deformed or crushed with the crests of the threads cold-flowing into the alternate valleys (see crushed threaded section 26*a*). As the first threads 26*a* substantially fill the straight die portion 23, a desired holding tension in the rod 13** is reached and the load is supported.

The entire internal length of the die 21, including the entrance portion 22 and the straight die portion 23 has an interference fit causing the deformation of the threads **26*a*. The surface engagement between the die 21 and the crushed threads 26*a*** establishes a frictional holding interface to provide the desired tension in the bolt assembly.

When tensioning the bolt assembly 10, an initial threshold level is selected that is clearly within the elastic limit of the rod 13. This lower limit and the fact that there is substantially no torque forces involved, maintains the rod 13 at a tension where fatigue is minimized. The rock is held under normal conditions, and then under emergency conditions caused by separation of rock, as shown by developed fault $F_1$ in FIG. 2, there is an increase in tension and a resultant yielding of coupling 14 to allow the rock to sag. The relative sliding movement in the coupling 14 prevents any significant increased tension and consequently, of course, maintains that tension well within the safety limits of the rod or bolt 13.

Figure 2:
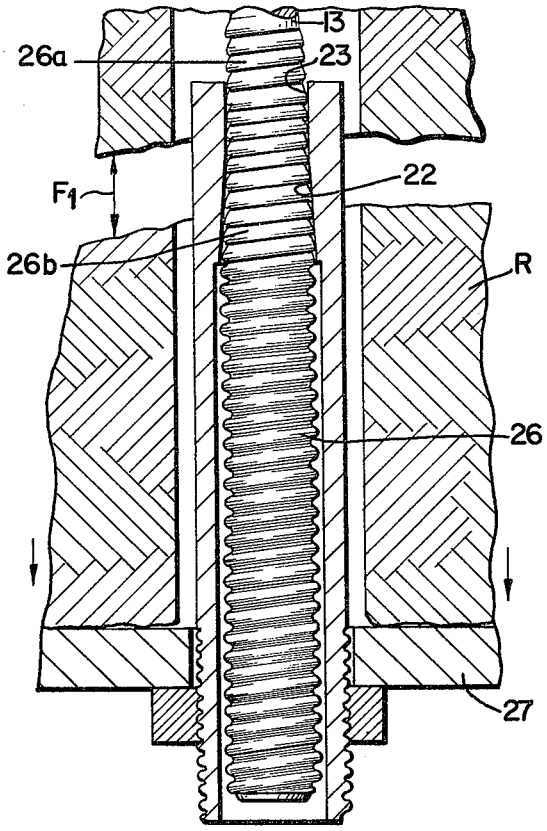
FIG. 2 is a detailed view of the yieldable coupling means of the assembly after a rock fault has developed.

To explain further, FIG. 2 shows the fault F having developed into the fault $F_1$ within the rock R and the movement that has occurred in the coupling 14. The straight die portion 23 has moved into engagement with the upper deformed threads 26*a* and additional threads 26*b* are now initially deformed by a wedge effect in the entrance portion 22. Once a thread has been fully deformed by crushing the threads in the straight die portion 23, the frictional holding interface is not significantly increased, and the design tension is thus substantially maintained and is fully effective to check further rock separation.

It will be noticed with the development of the fault $F_1$, the distal end of the threaded portion 26 has receded into the collar 25. This gives the inspector in the mine ready recognition that this area of the mine ceiling has experienced some rock sag. By checking the distance the end has moved up into the collar, the extent of the rock fault $F_1$ can be readily determined.

Most importantly, however, unlike in the prior art, with the rock fault $F_1$ having occurred, there is no eminent danger of failure of the bolt. The extended portion of threads 26 within the collar 20 is still available for enlargement of the fault $F_1$ or accommodation of other faults as they occur. And, it is clear that regardless of the size of the fault (within the gauged limits of the threaded portion 26), the rod 13 is maintained under substantially constant design tension. The additional movement of the collar 20 down the threaded portion 26 occurs only as is necessary to accommodate the forces within the rock R. The rock is held by the bolt without slackening of the tension that could cause other rock shifting in the immediate area.

A salient feature of the rock bolt assembly 10 of the present invention is that it is simple and reliable in construction. It makes use of standard rock bolt components and the collar 20 is relatively inexpensive to produce. The tolerances required for the interference fit between the die 21 and the cooperating threads 26 are not critical. Also, only the internal face of the die portions 22, 23 need be hardened. This prevents stripping or wearing of the metal in the collar as the threads 26 are engaged, thus assuring maintenance of the substantially constant tension regardless of how far down the threads the die has moved.

During the actual manufacture of the inventive bolt assembly 10, the collar 20 is required to be first inserted on the standard bolt 13 and moved toward the anchor 11 as far as possible. The lower end of the collar at this point clears the rod 13 where the threads 26 are to be formed. The threads 26 are formed by a cold-rolling operation. The material forming the crest of the threads is moved radially outwardly to a diameter greater than the diameter of the rod 13 thus providing requisite interference relationship.

As shown in FIG. 1, the crests are substantially the same diameter as the mouth of the tapered entrance portion 22. The crests extend above the nominal diameter of the rod 13 and the valleys are below. As the collar 20 is drawn downwardly to tension the rod 13, the initial threads 26*a* are crushed by cold-forming with a smooth, controlled action. From the point where the upper threads 26*a* begin to enter the entrance portion 22, there is an increase in tension up to the maximum design tension. After the first group of threads has fully entered the die portion 23, no further wedging action takes place, and thus from this point on it is substantially a constant tension operation, as explained above.

Figure 3:
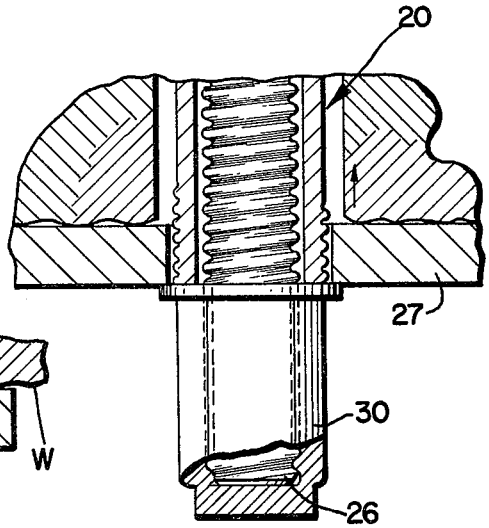
FIG. 3 is a detailed view of the lower portion of the assembly illustrating one method of torquing the rock bolt to set the anchor.

The expandable anchor 11 can be initially set by simply torquing the rod 13 before the yieldable coupling 14 is assembled, as previously pointed out. This can be done in any conventional way, but normally care should be taken not to prematurely strip or otherwise deform the threads 26. This is important so that in the event that the lower end of the threaded portion 26 is reached by the die during a support operation due to the development of an abnormally large fault $F_1$, the tension will remain the same and the bolt assembly 10 will thus hold with the design tension being maintained. Thus, one way of activating the anchor 11 would be to install a cap nut on the end of the threaded portion 26 and then draw the nut down tight or until it bottoms out against the distal end of the rod 13. As shown in FIG. 3, the collar 20 is conveniently temporarily moved upwardly to clear the lower section of the threaded portion 26. By using the plate 27, and holding the nut 30 upwardly during the tightening operation, such as by use of a socket and power tool urged upwardly from below, the anchor 11 is set at exactly the desired position. With each bolt assembly 10 uniformly set, the incidental indication function of the distal end of the rod 13 is operative. When the anchor 11 is fully expanded, the cap nut 30 is simply backed off, the collar 20 drops down into position, and the threaded support nut 28 is attached to the threads 29 on the collar to activate and set the coupling device 14.

In review, a yielding rock bolt 10 has been provided offering new potential for safety and efficiency in the mines. When a fault F develops in the supported rock, a controlled, substantially constant tension yielding of the coupling device 14 occurs. This provides exactly the right amount of relief needed to accommodate the fault F and allow the rock wall W to sag. The rock R is maintained steady under the substantially constant tension support thereby minimizing the chances of further loosening of the rock. However, in the event of additional rock separation, the collar 20 of the coupling device 14 simply moves further down the extended threaded portion 26 and stops just at the right position to again maintain the constant tension support. In effect, and simply put, the rock face W is allowed to move inward from its original position due to a developing fault to a new position where the design holding force is automatically re-established. The rock bolt assembly 10 is easy and inexpensive to fabricate, has a simple built-in indicating feature and is easy to install.

In this disclosure, there is shown and described only the preferred embodiment of the invention, but, as aforementioned, it is to be understood that the invention is capable of use in various other combinations and environment and is capable of changes or modifications within the scope of the inventive concept as expressed herein.

What is claimed is:

1. A yielding fastener assembly comprising a rod extending between two areas to be fastened together, anchor means at one end of said rod for connection to the adjacent area, and yieldable coupling means at least at the other end, said coupling means including a means movable along said rod and deformable holding means interacting between said rod and said movable means to allow substantially constant tension movement over an extended distance, and means for connecting the movable means to the area to be fastened adjacent said other end, whereby upon application of a predetermined force between said two areas, controlled relative movement is permitted to prevent exceeding the elastic limit of said rod.

2. The fastener assembly of claim 1 wherein said deformable holding means includes alternate crests and valleys formed on said rod and said movable means includes a collar and die means on said collar to extrude and flatten the crests into the valleys to provide a frictional holding interface thereby allowing the controlled movement.

3. The fastener assembly of claim 2 wherein said holding means comprises rolled threads.

4. The fastener assembly of claim 3 wherein the crests of the threads extend above the nominal diameter of said rod and the valleys below the nominal diameter, said die means being tubular and having a tapered leading entrance portion and a straight portion, said die means having a sliding fit with the nominal diameter and an interference fit with said threads.

5. The fastener assembly of claim 4 wherein said collar has an extension section normally overlying threads on said rod to provide extended relative movement.

6. A yielding fastener assembly to be mounted in a bore in rock to form a rock bolt assembly comprising a rod extending between two areas to be fastened together, anchor means at one end of said rod for connection to the inner end of the bore, and yieldable coupling means at least at the other end, said coupling means including means movable along said rod and deformable holding means interacting between said rod and said movable means to allow substantially constant tension movement over an extended distance, whereby upon application of a predetermined force between said two areas, controlled relative movement is permitted to prevent exceeding the elastic limit of said rod, said rod being a tension bolt, said anchor means to be locked in the inner end of said bore, and a plate connected to said movable means to support the rock face adjacent the outer end of said bore, whereby the rock may sag in a controlled fashion without exceeding the elastic limit of said bolt by operation of said yieldable coupling means.

7. The fastener assembly of claim 6 wherein said anchor means comprises an expandable anchor, removable cap means for the end of said bolt to apply torque to set said anchor, said cap means being operative to raise said collar to allow proper initial positioning of said bolt assembly in said bore.

8. A yielding fastener assembly comprising a rod extending between two areas to be fastened together, anchor means at one end of said rod for connection to the adjacent area, and yieldable coupling means at least at the other end, said coupling means including means movable along said rod and deformable holding means interacting between said rod and said movable means to allow substantially constant tension movement over an extended distance, a plate having a mounting aperture receiving the movable means adjacent to said other end and for connection to the adjacent area, and threaded means on said movable means cooperating with said plate to complete said coupling means to thereby provide the requisite holding force in said rod, whereby upon application of a predetermined force between said two areas, controlled relative movement is permitted to prevent exceeding the elastic limit of said rod.

* * * * *